United States Patent [19]

Ditto et al.

[11] 3,938,272

[45] Feb. 17, 1976

[54] TOY CANNON

[76] Inventors: Donald R. Ditto; Kenneth H. Hare, both of 3129 Maple Leaf Lane, Dallas, Tex. 75233

[22] Filed: Mar. 28, 1974

[21] Appl. No.: 455,854

[52] U.S. Cl. ..... 42/55; 89/7
[51] Int. Cl.[2] ..... F41F 1/00
[58] Field of Search ..... 42/55; 89/7

[56] References Cited

UNITED STATES PATENTS

| | | | |
|---|---|---|---|
| 1,352,715 | 9/1920 | Wily | 42/55 |
| 1,998,023 | 4/1935 | Peake | 42/55 |
| 1,999,357 | 4/1935 | Driggs, Jr. | 42/55 |
| 2,000,607 | 5/1935 | Peake | 42/55 |
| 2,754,607 | 7/1956 | Wily | 42/55 |
| 3,247,611 | 4/1966 | Wilson | 42/51 |
| 3,745,691 | 7/1973 | Brown, Jr. | 42/55 |

*Primary Examiner*—Charles T. Jordan
*Attorney, Agent, or Firm*—Howard E. Moore; Gerald G. Crutsinger

[57] ABSTRACT

A toy cannon for firing a resilient projectile when a compressed fuel-air mixture is ignited. Air is compressed into a chamber containing fuel as the resilient projectile is forced into the barrel of the cannon. An ignitor in the chamber is actuated from a shielded position externally of the chamber to ignite the fuel-air mixture.

4 Claims, 3 Drawing Figures

TOY CANNON

BACKGROUND OF INVENTION

Toy cannons which realistically simulate real cannons in sound and action have not been devised heretofore, presumably because of danger associated with the use of matches and explosives by inexperienced children.

Airborne toys such as rockets, heretofore devised, have been potentially dangerous because highly explosive fuel has been required to propel them. Such devices have been expensive, as a result of elaborate ignition apparatus comprising batteries and wires, rendering use of such devices economically prohibitive for a majority of the potential users. Another shortcoming of the heretofore highly technical airborne toys has involved a high degree of technical knowledge required to assure safe operation.

Other toys heretofore devised have employed mechanical means to produce sound effect. However, recorded sound transmitting devices have been of delicate construction resulting in frequent mechanical malfunctions or have required frequent replacement of batteries.

SUMMARY OF INVENTION

We have devised a toy cannon comprising a barrel and a combustion chamber separated by a perforated plate. A resilient ball is urged into the barrel, the ball compressing air into the combustion chamber containing fuel. The fuel-air mixture is ignited by a flint ignition system resulting in expansion of gases to force the ball out of the barrel.

A primary object of the invention is to provide a toy which can be used by children to project a soft, elastic projectile without danger to the user or others.

Another object of the invention is to provide a toy to safely ignite combustible material by providing ignition means within a combustion chamber sealed and separated from the user such that no matches are required, thereby eliminating potential fire hazards.

A further object of the invention is to provide a toy having sound effect and appearance which realistically simulate a cannon.

A still further object of the invention is to provide a toy cannon which employs readily replaceable tennis balls for projectiles.

Other and further objects of the invention will become apparent upon referring to the detailed description hereinafter following and to the drawing annexed hereto.

DESCRIPTION OF DRAWING

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
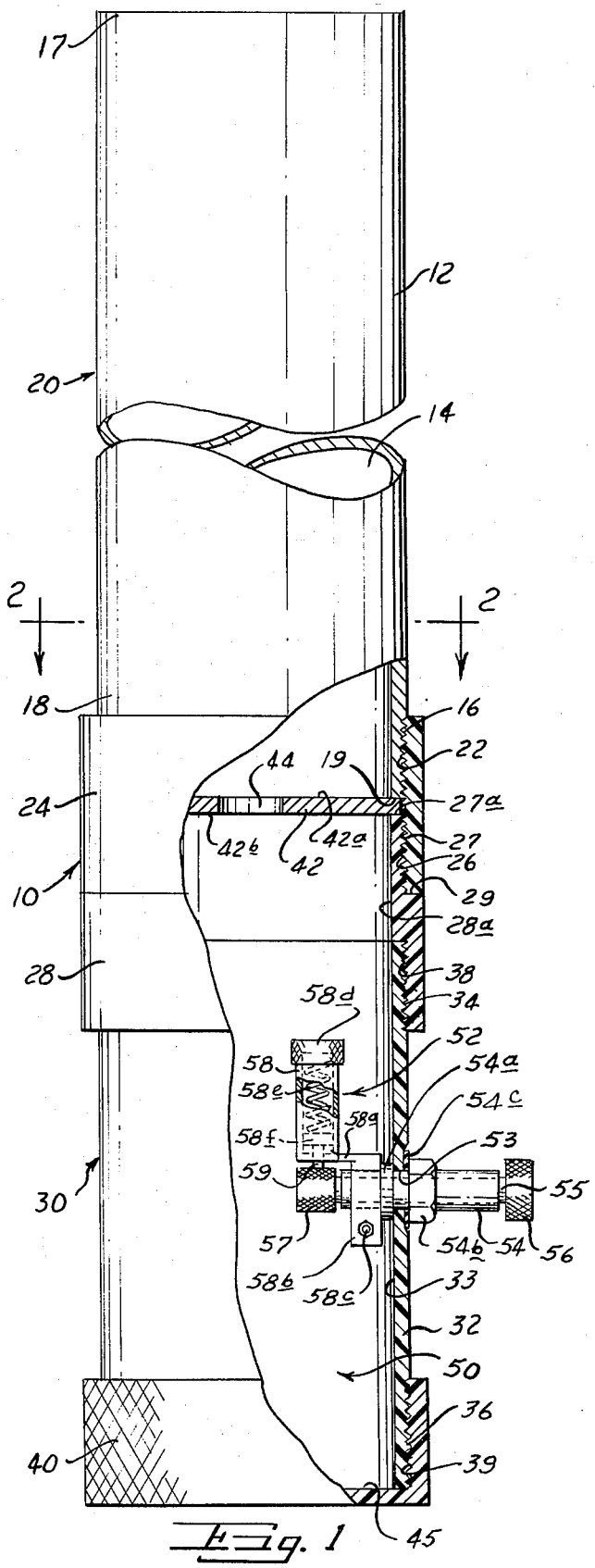
FIG. 1 is a fragmentary elevational view, parts being broken away to more clearly illustrate details of construction.
Figure 2:
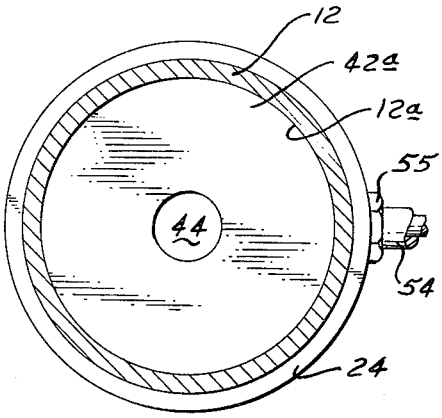
FIG. 2 is cross-sectional view taken along line 2—2 of FIG. 1.

Referring to FIG. 1 of the drawing, the numeral 10 generally designates a toy cannon having a barrel section 20 and a combustion chamber section 30.

The barrel section 20 preferably comprises a hollow tube 12 having a bore 14 extending longitudinally therethrough. Tube 12 has threads 16 formed in the outer surface thereof for connecting the breech end 18 of barrel section 20 to threads 22 formed in an end of internally threaded collar 24.

Threads 26 in the other end of internally threaded collar 24 engage threads 27 formed on the outer surface of coupling 28 adjacent shoulder 29 against which an end of collar 24 abutts.

The combustion chamber section 30 of the toy cannon 10 preferably comprises a hollow sleeve 32 having threads 34 and 36 formed on the outer surface adjacent opposite ends thereof. Threads 34 on one end of sleeve 32 engage internal threads 38 formed in the end of coupling 28 while threads 36 on the opposite end of sleeve 32 engage threads 39 formed on the inner surface of cap 40 forming a butt end of the toy cannon 10.

A partition plate 42 having a central passage 44 formed therethrough has a upper surface **42*a* in engagement with the end 19 of tubular member 12 adjacent the breech end 18 thereof. Plate 42 has a lower surface 42*b* in engagement with the end 27*a* of coupling 28.**

From the foregoing it should be readily apparent that plate 42 forms a partition across the bore 14 extending through the barrel section 20 of the toy cannon 10 and defines one end of a combustion chamber 50. The combustion chamber 50 is defined by the inner wall 33 of hollow sleeve 32 and by the inner wall **28*a* of hollow coupling 28, being bounded on one end by surface 42*b* of partition plate 42 and on the other end by the inner surface 45 of cap 40.**

Coupling 28, sleeve 32 and cap 40 are preferably constructed of material which is a good heat insulator such that there is no significant increase in the temperature of the outer surfaces thereof resulting from ignition of a combustible fuel-air mixture in combustion chamber 50.

Cap 40 preferably has a knurled outer surface to facilitate removal thereof from the threaded end of hollow sleeve 32 to evacuate products of combustion from the combustion chamber 50.

Figure 3:
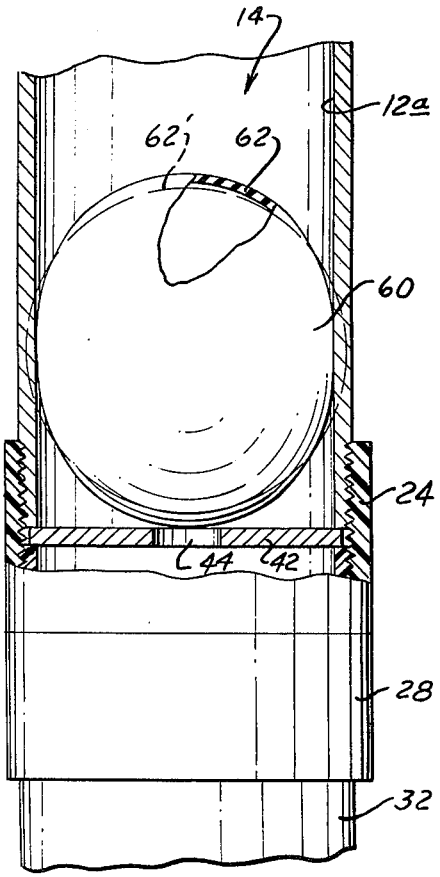
FIG. 3 is fragmentary cross-sectional view similar to FIG. 1, illustrating a resilient projectile positioned in the barrel.

The length and diameter of sleeve 32 and coupling 28 together with the length and diameter of tube 12 are proportioned such that movement of a resilient projectile 60 through tube 12 from the muzzle end 17 toward the breech end 18 to the position illustrated in FIG. 3 compresses air through aperture 44 into combustion chamber 50.

Ignition means 52 extends through a passage 53 formed in the wall of sleeve 32 for igniting a combustible fuel-air mixture in combustion chamber 50. The ignition means 52 comprises a sleeve bearing member 54 having an outwardly extending annular shoulder **54*a* formed thereabout intermediate opposite ends thereof which is urged into engagement with the inner surface 33 of sleeve 32 by a lock nut 54*b* threadedly secured to sleeve member 54. Suitable seal means, such as rubber washer 54*c*, is preferably provided about sleeve member 54 intermediate lock nut 54*b* and the outer surface of sleeve 32. A shaft 55 extends through sleeve bearing member 54 and has a knurled knob 56 on one end thereof and a friction wheel 57** rigidly secured to the other end.

A hollow tubular receptacle 58 has an outwardly extending lug 58*a* on the lower end thereof to which downwardly extending legs 58*b* are secured. Legs 58*b* extend around sleeve bearing 54 and are secured in position by suitable means such as bolt and threaded nut 58*c*. The upper end of receptacle 58 is threaded and has a cap 58*d* which restrains one end of a spring 58*e* disposed in receptacle 58 for urging piston 58*f* into engagement with flint-like member 59. Flint 59 extends through an opening in the bottom of receptacle 58 and is urged into engagement with friction wheel 57.

From the foregoing it should be readily apparent that rotation of knurled knob 56 imparts rotation to friction wheel 57 through shaft 55 for producing a spark in combustion chamber 50.

The spark producing flint-like element 59 is preferably an alloy, for example, iron and cerium, commercially available from Ronson Corporation, Woodbridge, New Jersey.

A projectile 60 preferably comprises a hollow ball having a resilient outer wall 62 constructed of natural rubber, synthetic rubber or plastic material which is deformable from a spherical body, diagrammatically illustrated in dashed outline, to an ellipsodial body, as illustrated in full outline when urged into the bore 14 extending through tube 12. The outside diameter of resilient projectile 60 is greater than the diameter of bore 14 and is therefore urged into sealing engagement with the inner wall 12*a* upon movement into the bore 14. Movement of projectile 60 through bore 14 from the muzzle end 17 of tube 12 toward the breech end 18 compresses air in the bore 14 through aperture 44 into combustion chamber 50.

OPERATION

The operation of function of apparatus hereinbefore described is as follows:

Cap 40 is removed from the butt end of cannon 10 and a suitable fuel, such as naptha, is injected into combustion chamber 50. Any suitable quantity and type of fuel may be employed. However, tests reveal that approximately three drops of lighter fluid, for example, Ronsonol, containing naptha, distributed by Ronson Corporation, Woodbridge, New Jersey, provides sufficient power to project a light, elastic tennis ball a substantial distance as a result of ignition in a combustion chamber having a volume equal to approximately one-third of the volume of bore 14.

After fuel has been deposited in combustion chamber 50, projectile 60 is moved into and through bore 14 in tube 12 to the position illustrated in FIG. 3.

Rotation of knob 56 produces a spark as a result of friction engagement of wheel 57 and flint-like element 59. The spark initiates combustion of the compressed fuel-air mixture in combustion chamber 50 causing immediate expansion of gases such that pressurized fluid moving through aperture 44 in partition 42 pressurizes bore 14 adjacent the breech end 18 of tube 12 causing projectile 60, the outer wall of which is in sealing engagement with inner wall 12*a* of tube 12, to be propelled rapidly through tube 12 and ejected therefrom.

It should be appreciated that after projectile 60 has been fired, combustion chamber 50 and bore 14 contain carbon dioxide and various other products of combustion. Cap 40 is removed from the end of combustion chamber 50 and products of combustion evacuated therefrom for example, by blowing into combustion chamber 50 to circulate fresh air thereto.

After products of combustion have been evacuated from combustion chamber 50, a fresh charge of fuel is injected and cap 40 is replaced.

It should be readily apparent that the toy cannon hereinbefore described and illustrated in the attached drawing, accomplishes the objects of the invention hereinbefore enumerated. The apparatus is of strong, durable construction having a minimum of moving parts.

Fuel is ignited by rotating knob 56 which is shielded from the combustion chamber 50 containing the compressed fuel-air mixture, thus rendering the device reasonably safe for use even by young, inexperienced children.

It should be appreciated that the structure hereinbefore described comprises a preferred embodiment of our invention and that other and further embodiments may be devised without departing from the basic concept thereof.

Having described our invention, we claim:

1. Apparatus to launch a resilient projectile comprising: a tubular barrel having a longitudinally extending bore open at one end; a combustion chamber adjacent an end of said bore, said combustion chamber having a volume approximately one-third the volume of the bore of the tubular barrel; said combustion chamber having an end cap removeably secured thereto to allow ventilation of the combustion chamber and the addition of a fresh charge of liquid hydro-carbon fuel upon removal; a partition plate having an aperture formed therein, said plate being positioned between the barrel and combustion chamber; ignition means in said combustion chamber to ignite the fuel; and a resilient projectile positionable in said bore, said projectile being larger than the diameter of said bore such that movement of said projectile through said bore towards said partition plate compresses a fuel-air mixture in said combustion chamber to increase the compression ratio of the fuel-air mixture, such that the position of the projectile relative to the partition plate determines the compression ratio of the fuel-air mixture.

2. The combination called for in claim 1 wherein the combustion chamber comprises: a hollow sleeve; a cap threadedly secured to one end of said sleeve; a partition plate having an aperture extending through a central portion thereof; and means to secure said partition plate across an end of said sleeve.

3. The combination called for in claim 2 wherein the barrel comprises a hollow tubular member having a bore extending longitudinally thereof; and means to secure an end of said tubular member such that said partition plate extends across an end thereof.

4. A toy cannon comprising: first and second hollow tubular members of substantially the same diameter, said second tubular member being about one-third the length of said first tubular member; a coupling threadedly engaged between said first and second tubular members joining the two tubular members; a plate having a passage therethrough disposed interiorly of the coupling between said first and second tubular members; an end cap threadedly engaged to the second tubular member to evacuate the second tubular member and allow fuel to be placed therein; a sleeve extending into the hollow portion of the second tubular member; a shaft journalled through said sleeve; a knob rigidly secured to a first end of said shaft exteriorly of the second tubular member; a knurled surfaced friction wheel rigidly secured to a second end of said shaft interiorly of the second tubular member; a flint; means to secure said flint in frictional engagement with said friction wheel; a resilient round projectile having a diameter slightly larger than the diameter of the first tubular member such that the outer surface of said projectile seals against the first tubular member such that as the projectile is moved toward the plate the air is compressed by a ratio of approximately three to one; whereby when a small amount of hydrocarbon fuel is placed in said second tubular member and is ignited by turning said friction wheel against said flint, the expanding gas produced by the ignited fuel mixture projects the projectile from the first tubular member.

* * * * *